United States Patent [19]

Fukuroi

[11] 4,454,733

[45] Jun. 19, 1984

[54] BEAM FOR USE IN TREATMENT OF TEXTILE STRIPS WITH TREATMENT LIQUID

[75] Inventor: Akio Fukuroi, Uozu, Japan

[73] Assignee: Yoshida Kogyo K.K., Tokyo, Japan

[21] Appl. No.: 302,731

[22] Filed: Sep. 16, 1981

[30] Foreign Application Priority Data

Sep. 27, 1980 [JP] Japan ..... 55-133694

[51] Int. Cl.[3] ..... D06B 23/04; B65H 75/18

[52] U.S. Cl. ..... 68/198; 242/118.1; 242/118.4

[58] Field of Search ..... 68/150, 189, 198; 242/118.1, 118.4, 118.7, 118.8

[56] References Cited

U.S. PATENT DOCUMENTS

| | | | |
|---|---|---|---|
| 2,513,418 | 7/1950 | MacNeill | 68/198 X |
| 2,594,366 | 4/1952 | Stienen | 68/189 X |
| 2,625,810 | 1/1953 | Reno et al. | 68/198 |

FOREIGN PATENT DOCUMENTS

| | | | |
|---|---|---|---|
| 679859 | 8/1939 | Fed. Rep. of Germany | 242/118.1 |

*Primary Examiner*—Philip R. Coe

*Attorney, Agent, or Firm*—Bucknam and Archer

[57] ABSTRACT

A beam for supporting therearound elongate strips of textile materal for uniform treatment with a treatment liquid, comprising a rotatable perforated cylindrical tube. The perforated cylindrical tube includes a central barrel portion, a pair of flanges disposed at opposite ends of the tube, and a pair of conical portions each disposed between the tube and a respective one of the flanges.

2 Claims, 2 Drawing Figures

BEAM FOR USE IN TREATMENT OF TEXTILE STRIPS WITH TREATMENT LIQUID

BACKGROUND OF THE INVENTION

1. Field of the Invention

This invention relates to apparatus for treatment of textile strips with dyeing, bleaching or other liquid media. More specifically, the invention pertains to a so-called "beam" for use with such treatment apparatus.

2. Prior Art

There are known a variety of beam devices, a typical example of which includes a perforated cylindrical tube or beam with both ends closed by disc flanges extending substantially at right angles to the axis of the tube. When wrapping the beam with an elongate strip of fabric tape, this is done by winding the strip helically from one end to the other and inverting the direction of feed of the same upon arrival at either of the opposed flanges of the beam, with the results that the layers of strip become less dense at the areas adjoining the flanges than at the remaining peripheral areas of the beam and hence are disposed less stably. As a treatment liquid is forced through the layers of strip or tape in such a condition, the flow of the liquid tends to be directed predominantly toward the less dense layer material at the flange areas, resulting in locally overtreated material or otherwise defective finish of the material. This difficulty, in the case of continuous slide fastener tapes carrying rows of couplng elements, would give rise to deformation of the tape web under the influence of liquid pressure. This tendency is greater the more volume of the wound material, imposing a control on the amount of material that can be wound on a beam of a given size.

SUMMARY OF THE INVENTION

With the foregoing difficulties of the prior art in view, the present invention aims at the provision of a beam, for treatment of textile strips with treatment liquid, which incorporates structural features to permit uniform distribution of layers of the textile strips to be wound on the beam and hence further permit treatment of increased amounts of textile material on a given size of beam.

This and other objects and features of the invention will be more apparent from reading the following description taken in connection with the accompanying drawing which illustrates by way of example a preferred embodiment.

According to the invention, there is provided a beam for use in treatment of elongate strips of textile material with a treatment liquid, comprising: a rotatable perforated cylindrical tube including a central barrel portion, a pair of flanges disposed at opposite ends of the tube, and a pair of conical portions each disposed between the central barrel portion and a respective one of the flanges.

BRIEF DESCRIPTION OF THE ACCOMPANYING DRAWING

FIG. 1 is a plan view, partly broken away, of a beam provided in accordance with the invention; and FIG. 2 is a longitudinal cross-sectional view of a part of the beam of FIG. 1, schematically illustrating slide fastener stringers wound on the beam.

DETAILED DESCRIPTION OF THE PREFERRED EMBODIMENT

Figure 1:
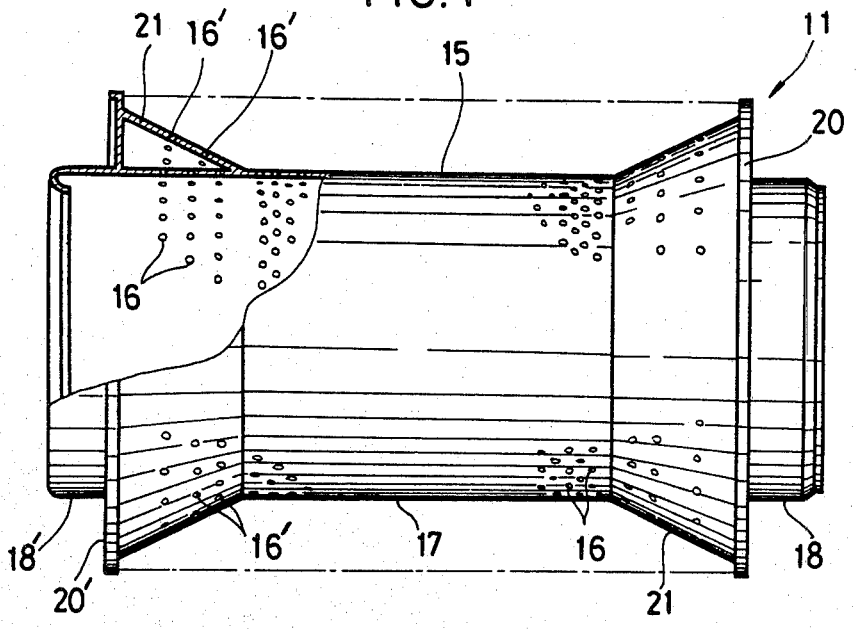
Figure 2:
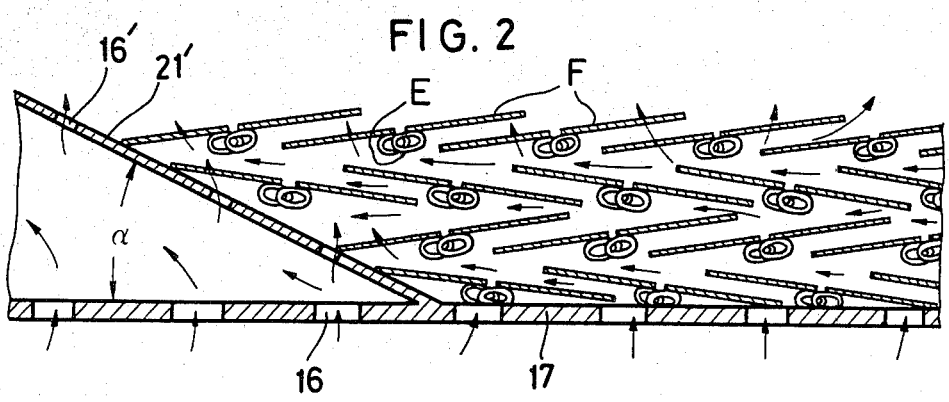

Referring now to the drawing and FIG. 1 in particular, there is shown a perforated cylindrical tube 11 commonly known as a "beam" around which relatively narrow, elongate strips of textile material are to be wound helically into a cylindrical form for treatment with dyeing, bleaching or other treatment liquid media.

The beam 11, as better shown in FIG. 1, comprises a cylindrical tube 15 provided with a multiplicity of perforations 16 through which a liquid medium such as a dye is allowed to pass radially outward from inside the tube 15 and penetrate the layers of material wound thereon, the material here being shown for illustrative purposes to be slide fastener stringers F carrying rows of coupling elements E.

The tube 15 has a central barrel portion 17 of uniform diameter and an extension 18 (FIG. 1) thereof at each of its ends engageable peripherally with a disc-like support (not shown) secured to a shaft (not shown) for driving the tube 15. A pair of disc flanges 20,20' are provided adjacent the respective end extensions 18,18' and extend a predetermined distance above the barrel portion 17.

The tube 15 further includes a pair of conical portions 21,21' which flare radially outward from the barrel portion 17 towards and are connected to the respective flanges 20,20'. The conical portions 21,21' are also provided with perforations 16' communicating with the interior of the tube 15, but these perforations should be adjusted in their number or in their size so as to reduce the amount of liquid flow per unit area commensurate with the thickness of the layers of material which diminishes progressively toward the flanges 20,20', so that the material at the conical portions 21,21' can be dyed or otherwise treated uniformly and substantially to the same extent as the portion of the material that is wound on the barrel 17 of the beam 11.

In the illustrated embodiment, the perforations 16' at each of the conical portions 21,21' are substantially equal in size to the perforation 16 at the barrel portion 17, but the pore-to-pore spacing of the perforations 16' increases proportionately with an increase in the diameter of the conical portion 21,(21').

It has now been found that the angle of inclination $\alpha$ of the generatrix of the conical portion 21,(21') with respect to the axis of the tube 15 is preferably of the order of $25° \pm 5°$ to obtain best results with treatment of ordinary slide fastener stringers having a fabric tape about 5–20 mm wide and a row of coupling elements about 3 to 4 times thicker than the tape. Departures from this angle range would result in off-specification products.

In the case of flat tapes, the above angle may be much greater but should not exceed 70°. If it is below 15°, then the results would be no more different than would be with a flangeless tubular beam.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A beam for use in the treatment with a liquid of an elongate textile strip wound around the beam, which beam comprises a hollow cylindrical tube including a central barrel portion having a multiplicity of perforations for the passage therethrough of the treatment liquid from the inside of said tube;

a pair of flanges disposed at opposite ends of said tube;

and a pair of frustroconical portions, each disposed between said perforated central barrel portion and one of said flanges, each frustroconical portion having a surface diverging toward said flange, said frustroconical portions each having a multiplicity of perforations spaced with a pore-to-pore spacing that increases proportionately with an increase in the diameter of the frustroconical portion, turns of the strip wound around said conical portion being held in contact with said surface at one of opposite longitudinal edge portions of the strip, said surface inclining at such an angle that the treatment liquid which has been passed through such perforations of said central barrel portion is uniformly distributed over the entire length of said tube, the angle of inclination of said surface being between 20° to 30° with respect to the axis of said tube.

2. A beam for use in the treatment with a liquid of an elongate textile strip wound around the beam, which beam comprises a hollow cylindrical tube including a central barrel portion having a multiplicity of perforations for the passage therethrough of the treatment liquid from the inside of said tube;

a pair of flanges disposed at opposite ends of said tube;

and a pair of frustroconical portions, each disposed between said perforated central barrel portion and one of said flanges, each frustroconical portion having a surface diverging toward said flange, wherein each of said frustroconical portions of said tube has perforations adjusted in their number or in their size to be commensurate with the thickness of the layers of strips to be wound therearound, turns of the strip wound around said conical portion being held in contact with said surface at one of opposite longitudinal edge portions of the strip, said surface inclining at such an angle that the treatment liquid which has been passed through said perforations of said central barrel portion is uniformly distributed over the entire length of said tube, the angle of inclination of said surface being between 20° to 30° with respect to the axis of said tube.

* * * * *